US007360652B2

(12) United States Patent
Arnold

(10) Patent No.: US 7,360,652 B2
(45) Date of Patent: Apr. 22, 2008

(54) CHILD RESISTANT PRODUCT DISPENSER

(75) Inventor: William Arnold, Doylestown, PA (US)

(73) Assignee: R.P. Scherer Technologies, Inc., Las Vegas, NV (US)

( * ) Notice: Subject to any disclaimer, the term of this patent is extended or adjusted under 35 U.S.C. 154(b) by 227 days.

(21) Appl. No.: 10/866,268

(22) Filed: Jun. 11, 2004

(65) Prior Publication Data

US 2005/0274643 A1 Dec. 15, 2005

(51) Int. Cl.
*B65D 83/04* (2006.01)

(52) U.S. Cl. ..... 206/538; 206/531

(58) Field of Classification Search ..... 206/538, 206/531, 534, 528, 532, 534.1, 539
See application file for complete search history.

(56) References Cited

U.S. PATENT DOCUMENTS

| | | | | | |
|---|---|---|---|---|---|
| 3,387,699 | A | | 6/1968 | Heller | 206/42 |
| 3,921,804 | A | | 11/1975 | Tester | 206/531 |
| 3,924,747 | A | | 12/1975 | Gerner | 206/531 |
| 4,120,400 | A | | 10/1978 | Kotyuk | 206/528 |
| 4,125,190 | A | | 11/1978 | Davie, Jr. et al. | 206/532 |
| 4,192,422 | A | | 3/1980 | Kotyuk | 206/528 |
| 4,537,312 | A | | 8/1985 | Intini | 206/531 |
| 4,664,262 | A | | 5/1987 | White | 206/531 |
| 4,838,425 | A | * | 6/1989 | O'Brien et al. | 206/531 |
| 4,889,236 | A | | 12/1989 | Bartell et al. | 206/531 |
| 4,911,304 | A | | 3/1990 | Bunin | 206/531 |
| 4,974,729 | A | | 12/1990 | Steinnagel | 206/531 |
| 5,019,125 | A | * | 5/1991 | Rebne et al. | 206/532 |
| 5,109,984 | A | | 5/1992 | Romick | 206/531 |
| 5,150,793 | A | | 9/1992 | Tannenbaum | 206/531 |
| 5,242,055 | A | | 9/1993 | Pora | 206/532 |
| 5,265,728 | A | | 11/1993 | Allendorf et al. | 206/534 |
| 5,275,291 | A | * | 1/1994 | Sledge | 206/531 |
| RE35,445 | E | | 2/1997 | Pora | 206/532 |
| 5,862,915 | A | | 1/1999 | Plezia et al. | 206/528 |
| 5,878,887 | A | | 3/1999 | Parker et al. | 206/528 |
| 5,878,888 | A | | 3/1999 | Faughey et al. | 206/530 |
| 5,894,930 | A | | 4/1999 | Faughey et al. | 206/532 |
| 5,915,559 | A | | 6/1999 | Hulick et al. | 206/536 |
| 5,927,500 | A | | 7/1999 | Godfrey et al. | 206/531 |
| 6,024,222 | A | | 2/2000 | Friberg et al. | 206/531 |
| 6,155,424 | A | * | 12/2000 | Dubach | 206/531 |
| 6,155,454 | A | | 12/2000 | George et al. | 206/531 |
| 6,161,699 | A | | 12/2000 | Gartland | 206/531 |
| 6,173,838 | B1 | | 1/2001 | Brozell | 206/538 |
| 6,244,462 | B1 | | 6/2001 | Ehrensvard et al. | 221/7 |
| 6,273,260 | B1 | | 8/2001 | ColDepietro et al. | 206/532 |
| 6,345,717 | B1 | * | 2/2002 | Flewitt | 206/531 |
| 6,349,831 | B1 | | 2/2002 | Buss | 206/531 |
| 6,357,593 | B1 | | 3/2002 | Bolnick et al. | 206/531 |
| 6,382,412 | B1 | | 5/2002 | Wood | 206/232 |
| 6,411,567 | B1 | | 6/2002 | Niemiec et al. | 368/10 |

(Continued)

*Primary Examiner*—J. Gregory Pickett
(74) *Attorney, Agent, or Firm*—Lowenstein Sandler PC

(57) ABSTRACT

A child resistant product dispenser includes a blister card having compartments for holding a product, a housing, and a blister cover for use in covering the blister card compartments. The blister cover may include a dispensing area for each compartment of the blister card. To remove a product from the product dispenser the user presses a dispensing area against either a compartment thereby forcing the product through a frangible area on the blister card and through a frangible area in the housing or against a peelable area on the blister card and a frangible area in the housing. This creates an opening through which the product is removed.

13 Claims, 16 Drawing Sheets

U.S. PATENT DOCUMENTS

| | | | | |
|---|---|---|---|---|
| 6,412,636 | B1 | 7/2002 | Jones et al. | 206/532 |
| 6,460,693 | B1 | 10/2002 | Harrold | 206/1.5 |
| 6,471,063 | B2 | 10/2002 | Stepp | 206/530 |
| 6,491,211 | B1 | 12/2002 | Evans et al. | 229/102 |
| 6,520,329 | B1 | 2/2003 | Fuchs et al. | 206/449 |
| 6,523,691 | B2 | 2/2003 | Raj et al. | 206/538 |
| 6,540,081 | B2 | 4/2003 | Balz et al. | 206/531 |
| 6,543,209 | B1 | 4/2003 | Siegel et al. | 53/492 |
| 6,564,945 | B1 | 5/2003 | Weinstein et al. | 206/531 |
| 6,589,642 | B1 | 7/2003 | Miller et al. | 428/220 |
| 6,592,978 | B1 | 7/2003 | Miller et al. | 428/213 |
| 6,598,745 | B2 | 7/2003 | Bolnick et al. | 206/531 |
| 6,637,431 | B2 | 10/2003 | Ekelius et al. | 128/203.15 |
| 6,641,031 | B2 | 11/2003 | Evans et al. | 229/102 |
| 6,726,053 | B1 * | 4/2004 | Harrold | 221/25 |
| 7,000,769 | B2 * | 2/2006 | Killinger | 206/534 |
| 2002/0066690 | A1 | 6/2002 | Mattis et al. | 206/532 |
| 2002/0153276 | A1 | 10/2002 | Filion et al. | 206/531 |
| 2002/0162768 | A1 | 11/2002 | Bolnick et al. | 206/532 |
| 2002/0166790 | A1 | 11/2002 | Aylward | 206/531 |
| 2002/0166791 | A1 | 11/2002 | Donegan | 206/531 |
| 2002/0166792 | A1 | 11/2002 | Filion et al. | 206/532 |
| 2002/0185404 | A1 | 12/2002 | Donegan | 206/531 |
| 2003/0006163 | A1 | 1/2003 | Patterson | 206/531 |
| 2003/0042167 | A1 | 3/2003 | Balz et al. | 206/531 |
| 2003/0080021 | A1 | 5/2003 | Kopecky | 206/531 |
| 2003/0085262 | A1 | 5/2003 | Evans et al. | 229/102 |
| 2003/0102247 | A1 | 6/2003 | Inoue et al. | 206/532 |
| 2003/0111379 | A1 | 6/2003 | Intini | 206/531 |
| 2003/0111479 | A1 | 6/2003 | Taneja et al. | 221/25 |
| 2003/0168376 | A1 | 9/2003 | Taneja et al. | 206/534 |
| 2003/0183551 | A1 | 10/2003 | Hulick | 206/531 |
| 2003/0209460 | A1 | 11/2003 | Bolnick et al. | 206/531 |
| 2003/0209461 | A1 | 11/2003 | French et al. | 206/538 |
| 2003/0213721 | A1 | 11/2003 | Jones | 206/528 |
| 2005/0082194 | A1 * | 4/2005 | Fry et al. | 206/531 |

* cited by examiner

CHILD RESISTANT PRODUCT DISPENSER

I. BACKGROUND OF THE INVENTION

A. Field of Invention

This invention relates to apparatuses and methods for holding and dispensing products and more particularly to apparatuses and methods for holding and dispensing products positioned in a blister card with a child resistant product dispenser.

B. Description of the Related Art

It is well known to provide certain products in what is called a blister card. Blister cards generally have a first member defining a plurality of compartments (also known as blisters) that hold products, such as medicine pills, and a second member that seals the products within the compartments or blisters. There are two general types of second members. The first type of second member has a number of frangible areas with one frangible area positioned adjacent to each compartment. To remove the product from the compartment the user simply presses down on the compartment thereby forcing the product through the frangible area. Such blister cards work well for use with products that can withstand the pressure exerted on them by the user for removal.

For products that cannot withstand such pressure, such as relatively soft pills, the blister card may use the second type of second member which includes a peelable area positioned adjacent to each compartment. To remove the product, the user simply peels the peelable area away from the blister card to create an opening to the compartment. The product is then easily removed from the compartment by allowing the product to drop or fall out of the compartment under the force of gravity and into the user's hand, for example. Blister cards generally work well for their intended purpose. However, known blister cards have the disadvantage of being relatively easy for children to open. Typical blister cards also have a disadvantage related to the fact that the compartments or blisters extend from the second member of the card. The extended compartments are relatively easy for small children to bite. Such biting has the unfortunate possibility of opening the compartment and releasing the contents of the compartment into the child's mouth. Thus, what is needed is a product dispenser that is easy for an adult to open yet difficult for children to open whether with their hands or with their mouths.

Many efforts have been made to produce a child resistant product dispenser. However, none of the devices known in the art provide the benefits and advantages provided by the inventors of this patent. These advantages are described below.

II. SUMMARY OF THE INVENTION

According to one aspect of this invention, a method of assembling a product dispenser is provided. This method includes the steps of providing a housing, positioning a blister card relative to the housing, and covering the blister card with a blister cover having a plurality of dispensing areas. One dispensing area is provided for each compartment so that each dispensing area is in alignment with a corresponding compartment. Finally, the blister cover is attached to or retained in the housing.

According to another aspect of this invention, in the preferred embodiment the blister cover has a flange portion which is attached, preferably by heat seal or adhesive, both on top and on bottom to the housing of the product dispenser.

According to another preferred embodiment of this invention, the product dispenser housing includes a bottom having a plurality of frangible areas each of which is lined up with or juxtaposed to a corresponding frangible area on the second member of the blister card.

According to another aspect of this invention, the blister cover has a top surface adjacent to the dispensing areas for use in greatly reducing access to the blister card compartments and thus preventing children from biting them.

According to one embodiment of this invention, to dispense a product from the inventive product dispenser the user presses a dispensing area on the blister cover against a compartment in the blister card. This forces the product through a frangible area on the second member of the blister card and then through a frangible area in the housing.

According to another embodiment of this invention, to dispense a product from the inventive product dispenser the user presses a dispensing area against a peelable area on the blister card and a frangible area in the housing. This pressing force removes an edge of the peelable area and an edge of the frangible area away from the corresponding compartment. Both the peelable area and frangible area are then peeled back to create an opening to the compartment through which the product can easily be removed.

One advantage of this invention is that the product dispenser is child resistant yet easy for adults, including the elder and disabled, to open.

Another advantage of this invention is that children cannot bite through the compartments (blisters) to gain unwanted access to the products.

Still another advantage of this invention is that in the preferred embodiment a two-step attaching process, preferably either a heat sealing process or an adhesive process, is used to attach the blister cover to the product dispenser housing.

Still yet another advantage of this invention is that the blister cover provides at least one communication surface which can be used for any purpose which may include compliance aids such as dosage text, day labels, Braille and the like.

Still other benefits and advantages of the invention will become apparent to those skilled in the art to which it pertains upon a reading and understanding of the following detailed specification.

III. BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein.

IV. DESCRIPTION OF THE PREFERRED EMBODIMENT

Figure 1:
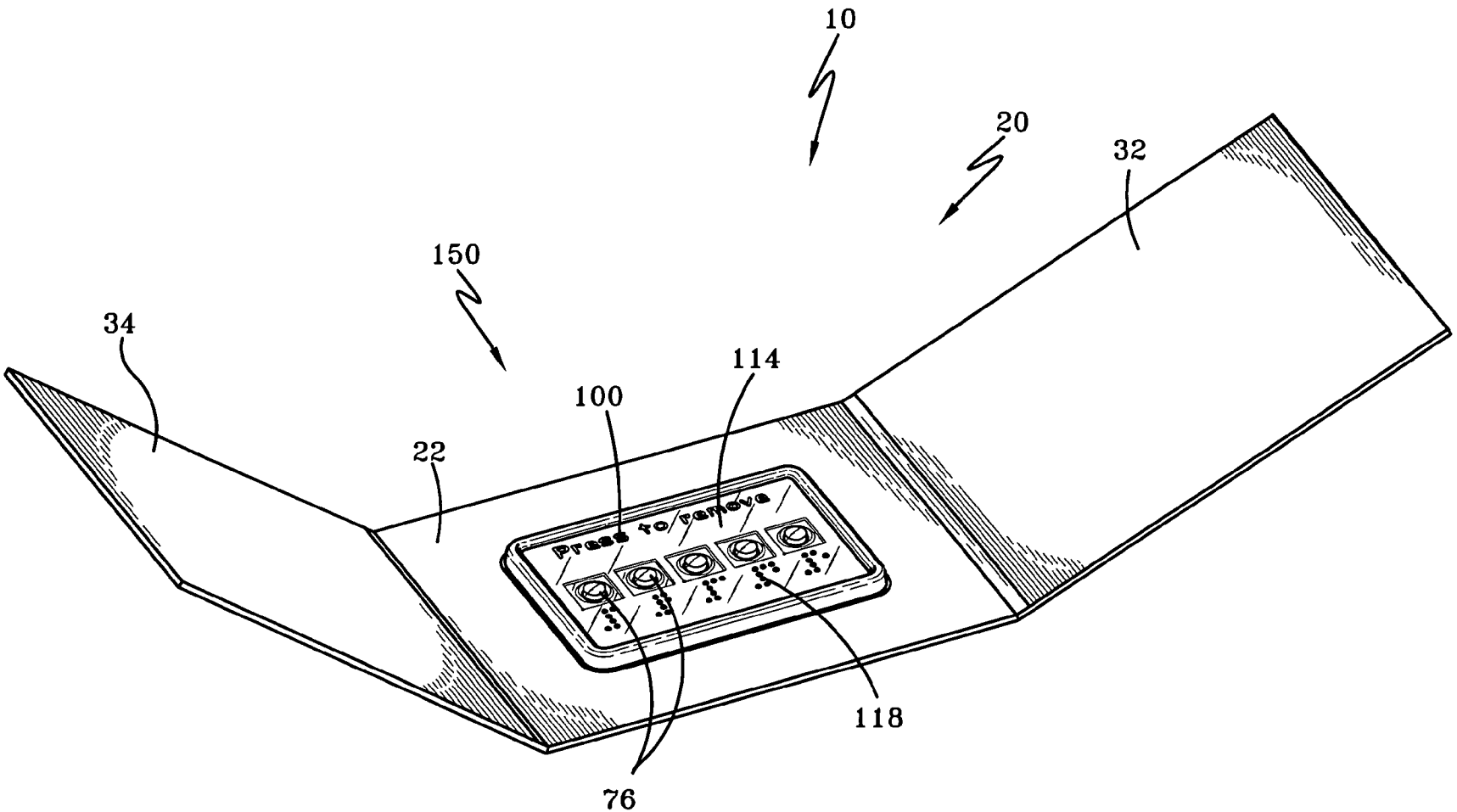
FIG. 1 is a perspective view of the product dispenser of this invention shown with the side members folded open so that access to the products can be achieved.
Figure 2:
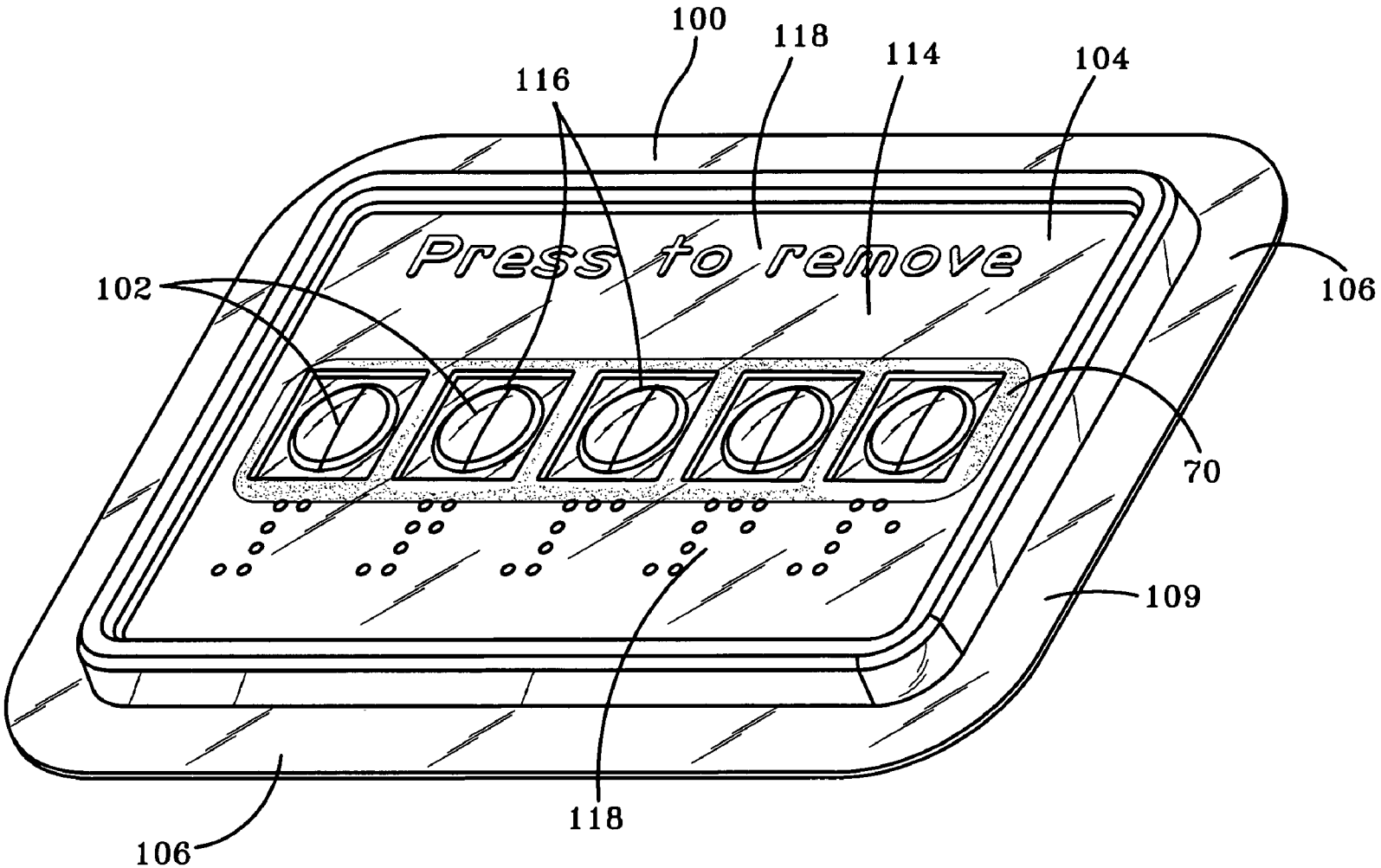
FIG. 2 is a perspective view of the blister cover showing a top surface adjacent to the dispensing areas for use in preventing children from biting individual compartments in the blister card.
Figure 3:
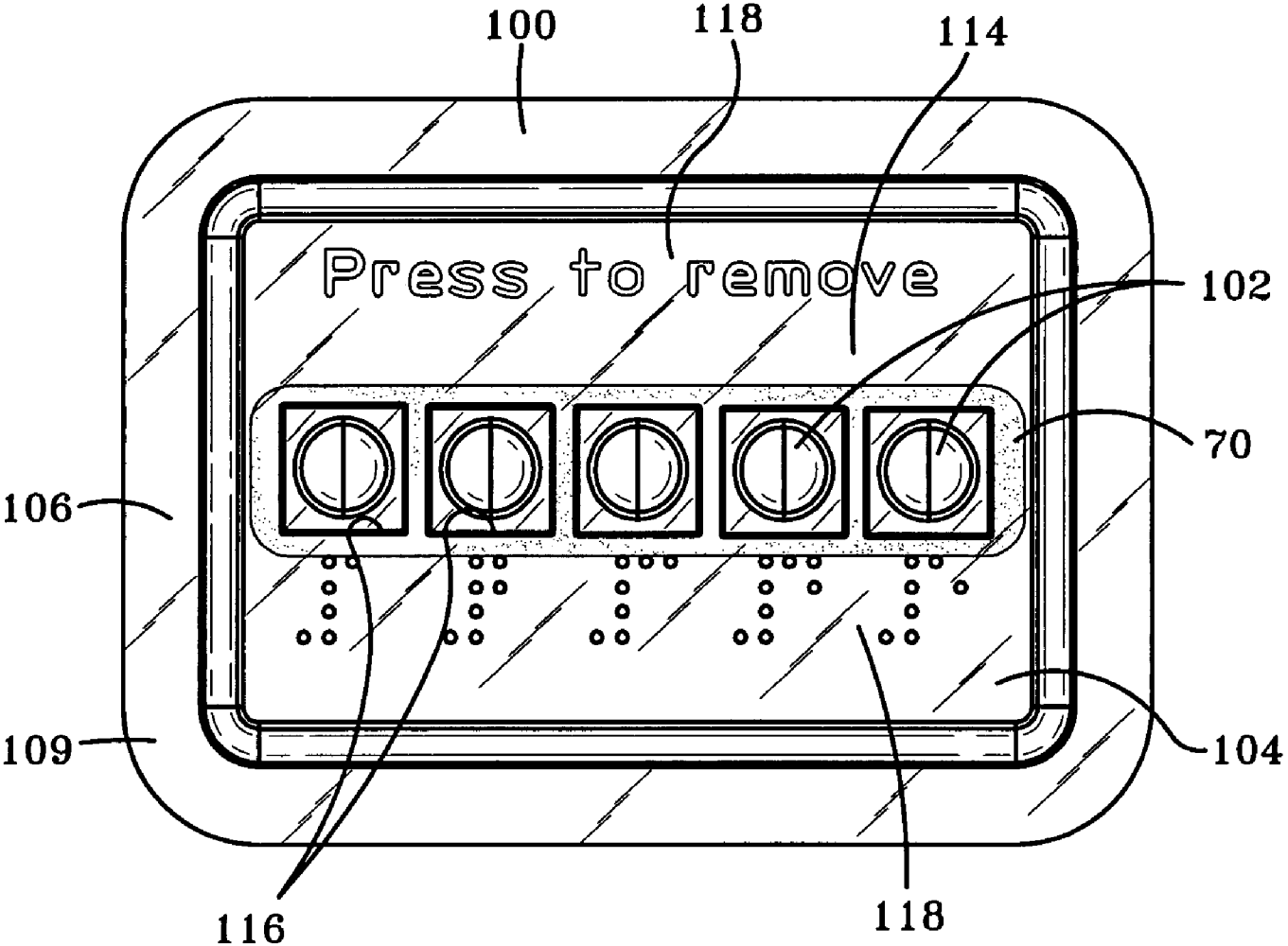
FIG. 3 is a top view of the blister cover shown in FIG. 2.
Figure 4:
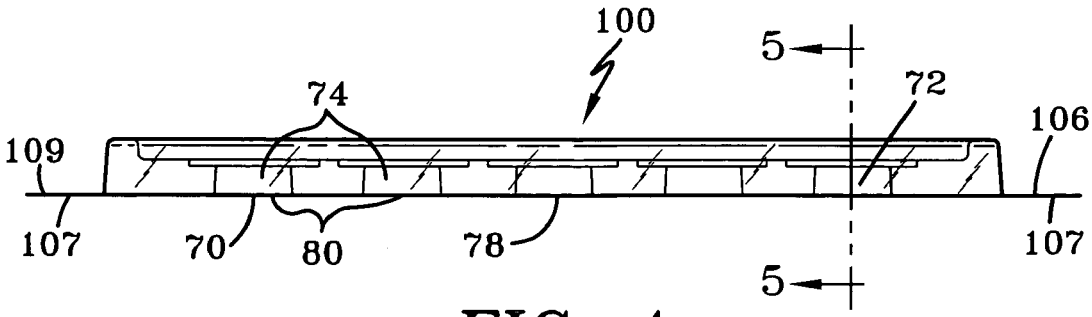
FIG. 4 is a side view of the blister cover shown in FIG. 3.
Figure 5:
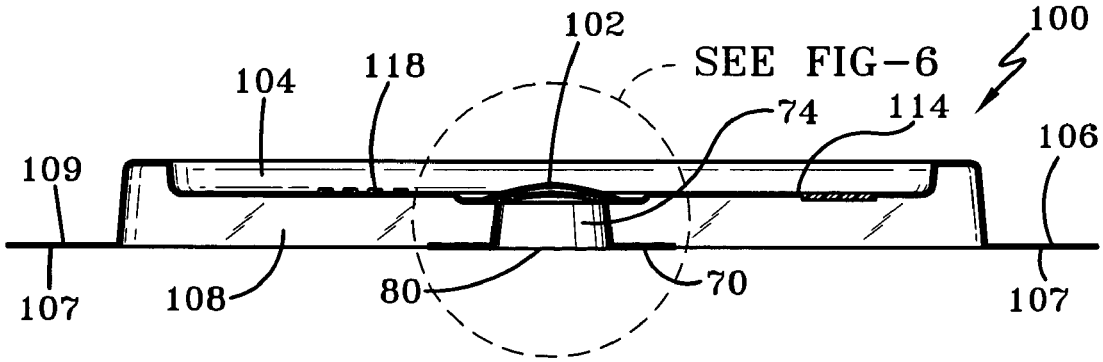
FIG. 5 is a view taken along the line 5-5 of FIG. 4 and showing the cavity within the blister cover that receives the blister card.
Figure 6:
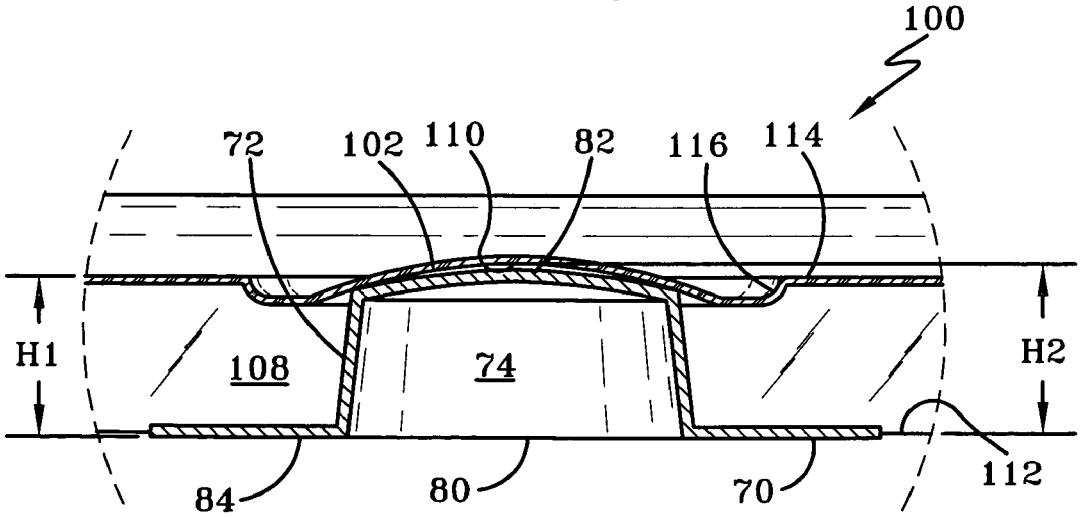
FIG. 6 is a detail of section 6-6 shown in FIG. 5.

Referring now to the drawings wherein the showings are for purposes of illustrating a preferred embodiment of the invention only and not for purposes of limiting the same, FIG. 1 shows the inventive product dispenser 10 shown with the side members folded open so that the blister cover 100 can be seen. Below the blister cover 100 is a conventional blister card 70 having frangible areas 80 as will be discussed further below.

With reference to FIGS. 3-6 and 9, the blister card 70 has a first member 72 defining a plurality of compartments or blisters 74. Each of the compartments 74 is used to hold corresponding product 76. It should be noted that the product 76 can be any chosen with sound judgment. In one anticipated use, the product 76 would be some type of medication generally in pill form. It should be noted that while throughout this application one product is shown as fitting within one compartment 74, the one product 76 could in fact include a number of separate pieces. Thus, for example, one compartment 74 may have two or more individual pieces such as multiple pills. The first member 72 is typically formed of a clear plastic like material such as polyvinyl chloride (PVC). However, the specific material used can be any chosen with sound engineering judgment for this invention.

With continuing reference to FIGS. 3-6 and 9, a second member 78 is used to seal the products within the compartments 74. This second member 78 has a plurality of frangible areas 80 which can be broken or ruptured upon application of sufficient pressure. It should be noted that one frangible area 80 is positioned juxtaposed to each compartment 74. In this way, to remove a product 76 from a compartment 74, it is only necessary to press on or apply a force to each compartment 74 thereby forcing the product 76 through the frangible area 80. The second member 78 and frangible areas 80 may be formed of any material chosen with sound engineering judgment, such as, aluminum foil. The second member 78 is attached to the first member 72 in any manner chosen with sound engineering judgment.

With reference again to FIG. 1, the product dispenser 10 of this invention includes housing 20, a blister cover 100 for use in covering the compartments 74 of the blister card 70, and connecting means 150 for use in operatively connecting the blister card 70 and the blister cover 100 to the housing 20. The blister card 70 and blister cover 100 are positioned relative to each other and relative to the housing 20 as will be discussed further below. Although a typical blister card 70 has been described, it should be understood that this invention can work with many other blister cards 70.

Figure 7:
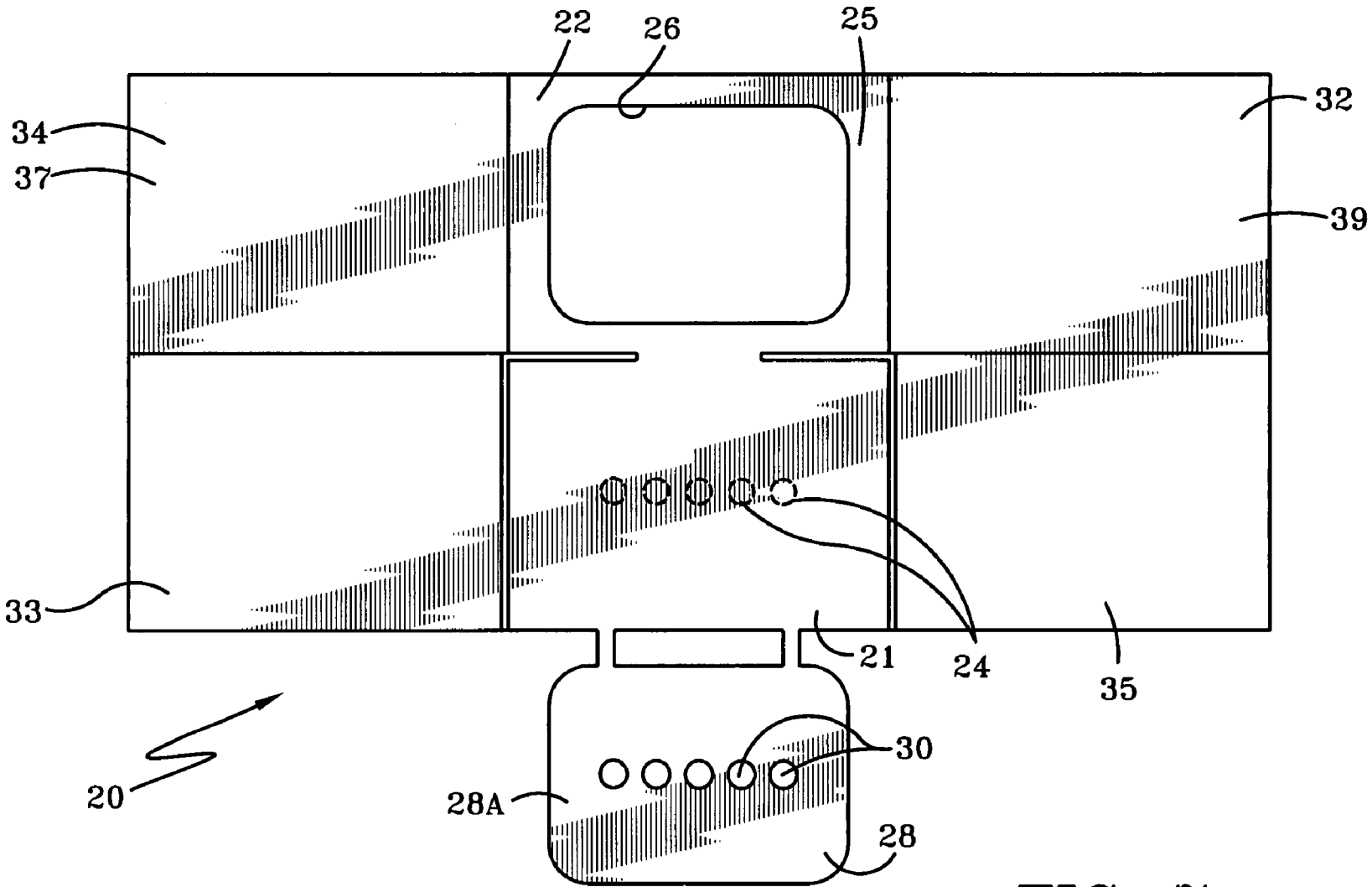
FIG. 7 is a top view of the housing shown prior to the placement of the blister card.

With reference now to FIGS. 1 and 7-10, the housing 20 will be described in more detail. FIG. 7 shows the housing 20 in an early form of assembly. It should be noted that the housing 20 can be formed of any material chosen with sound engineering judgment. In the preferred embodiment, however, the housing 20 is formed of a card stock. The housing 20 has a top member 22, a bottom member 21, a middle member 28 and a pair of side members 32 and 34. As can be seen by comparing FIG. 7 to FIG. 8, the side members 32, 34 are preferably made by folding members 33 and 35 onto members 37 and 39 respectively. This creates a double layer thickness for the side members 32 and 34. It should be understood, however, that a single layer would work well for this invention. The top member 22 has an aperture 26 for use in receiving the blister cover 100 as will be described further below. The bottom member 21 may also have a plurality of frangible areas 24. These frangible areas 24 are used in the process of dispensing the product 76 as will be discussed further below.

Figure 10:
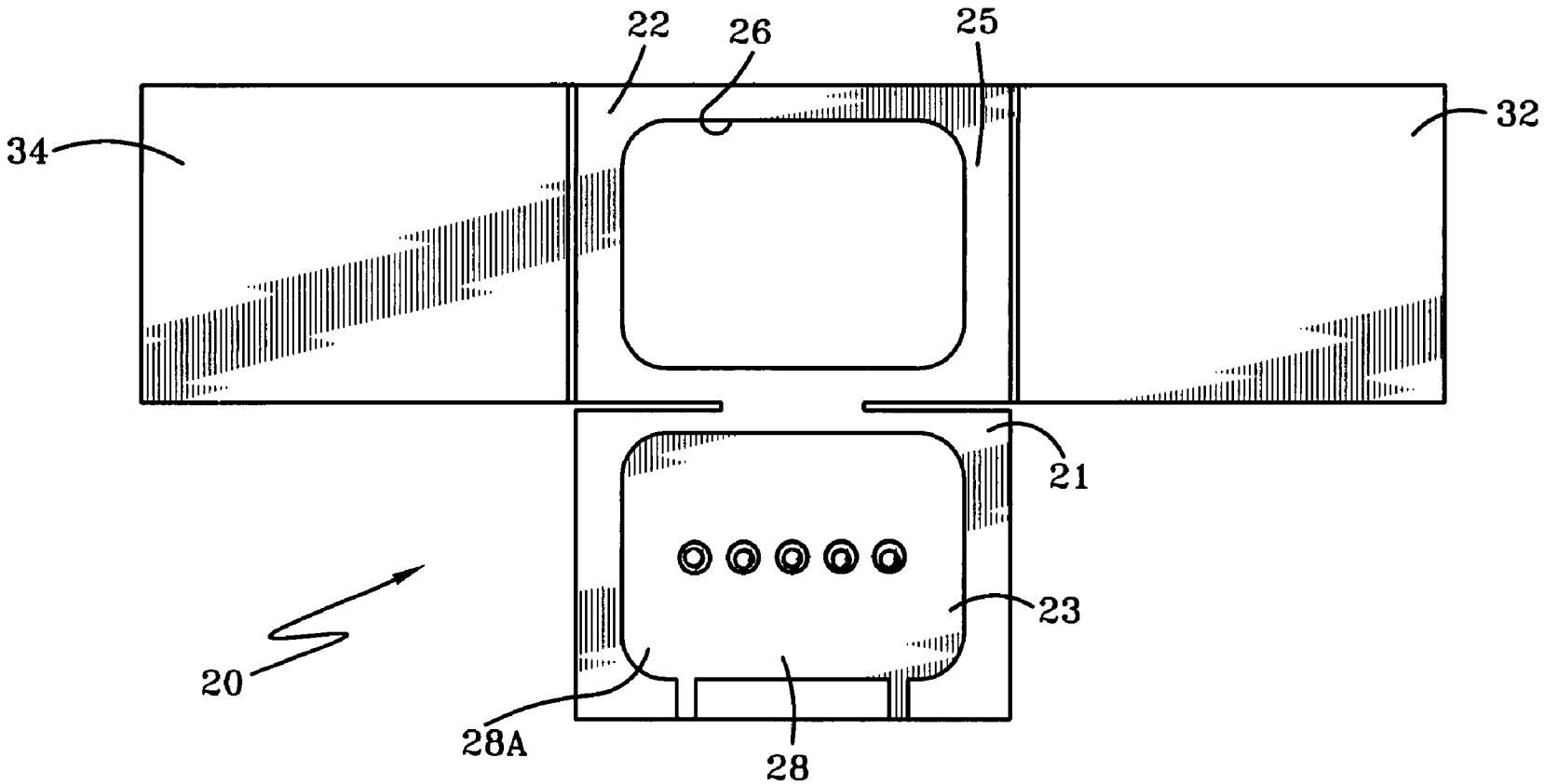
FIG. 10 is a view similar to that shown in FIG. 9, but with the middle member shown folded over the blister card.
Figure 11:
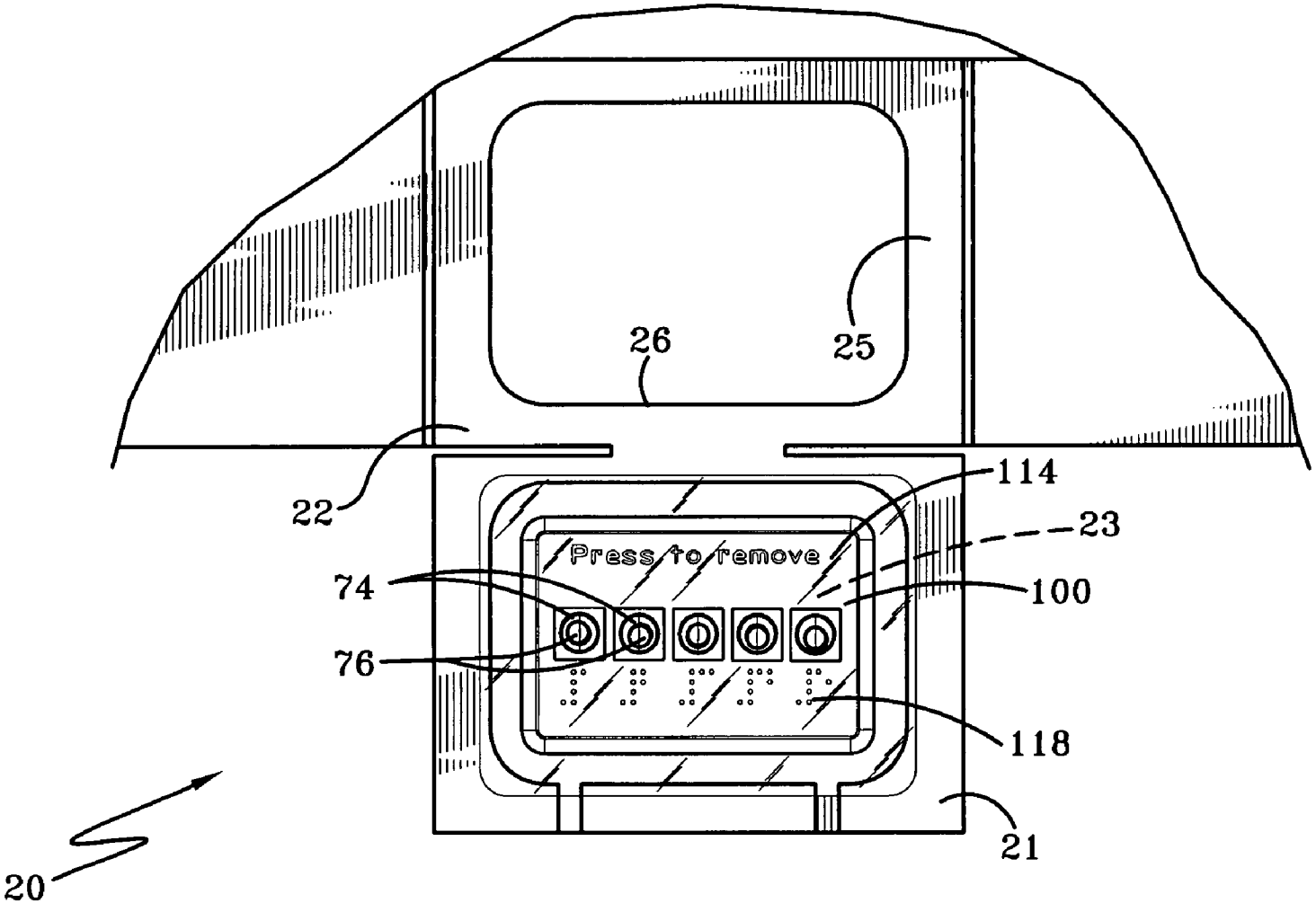
FIG. 11 is a view similar to that shown in FIG. 10, but with the blister cover shown placed over the middle member and over the blister card.
Figure 12:
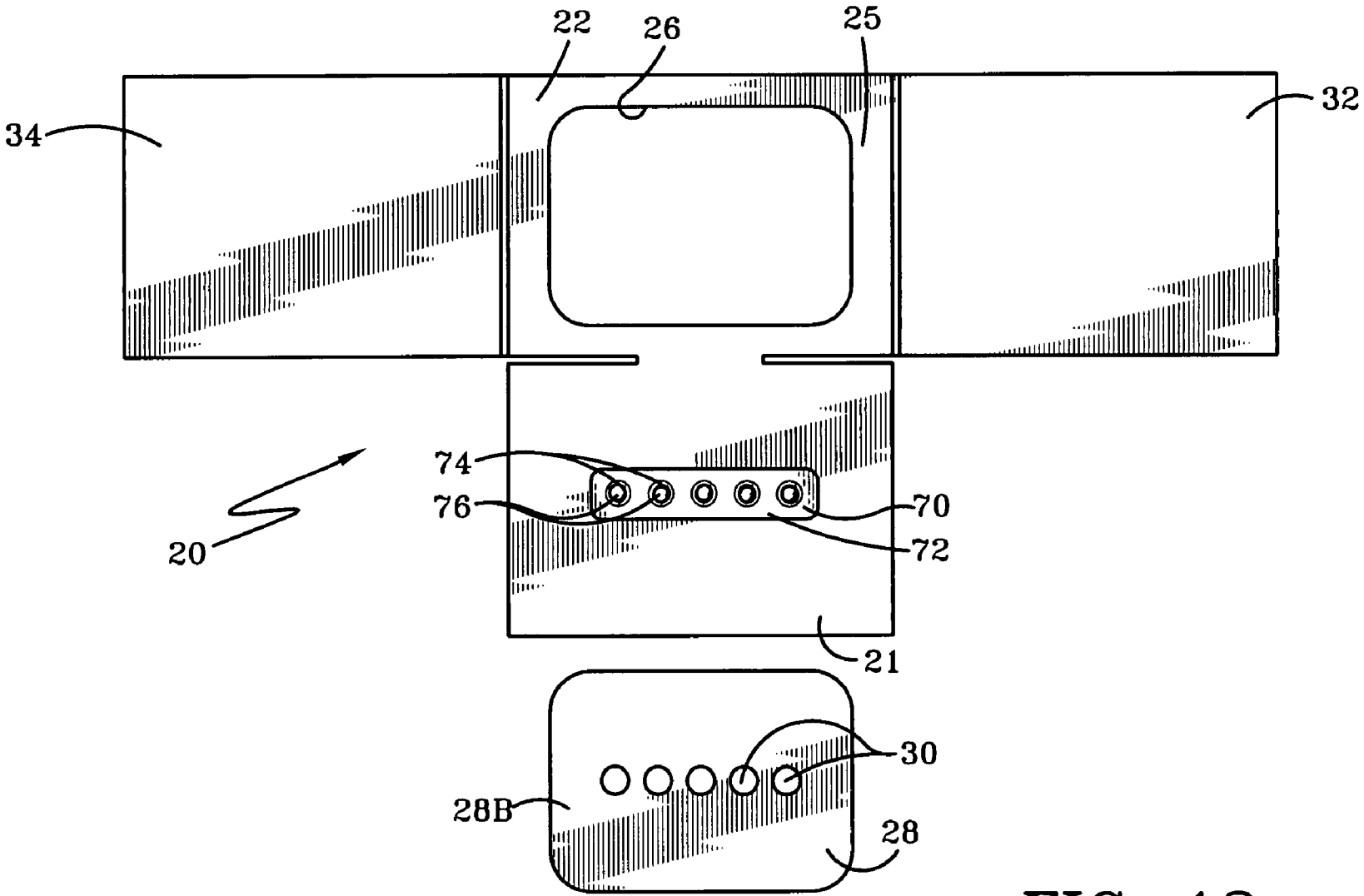
FIG. 12 is a view similar to that shown in FIG. 9, but with the middle member shown as a piece separate from the rest of the housing.
Figure 13:
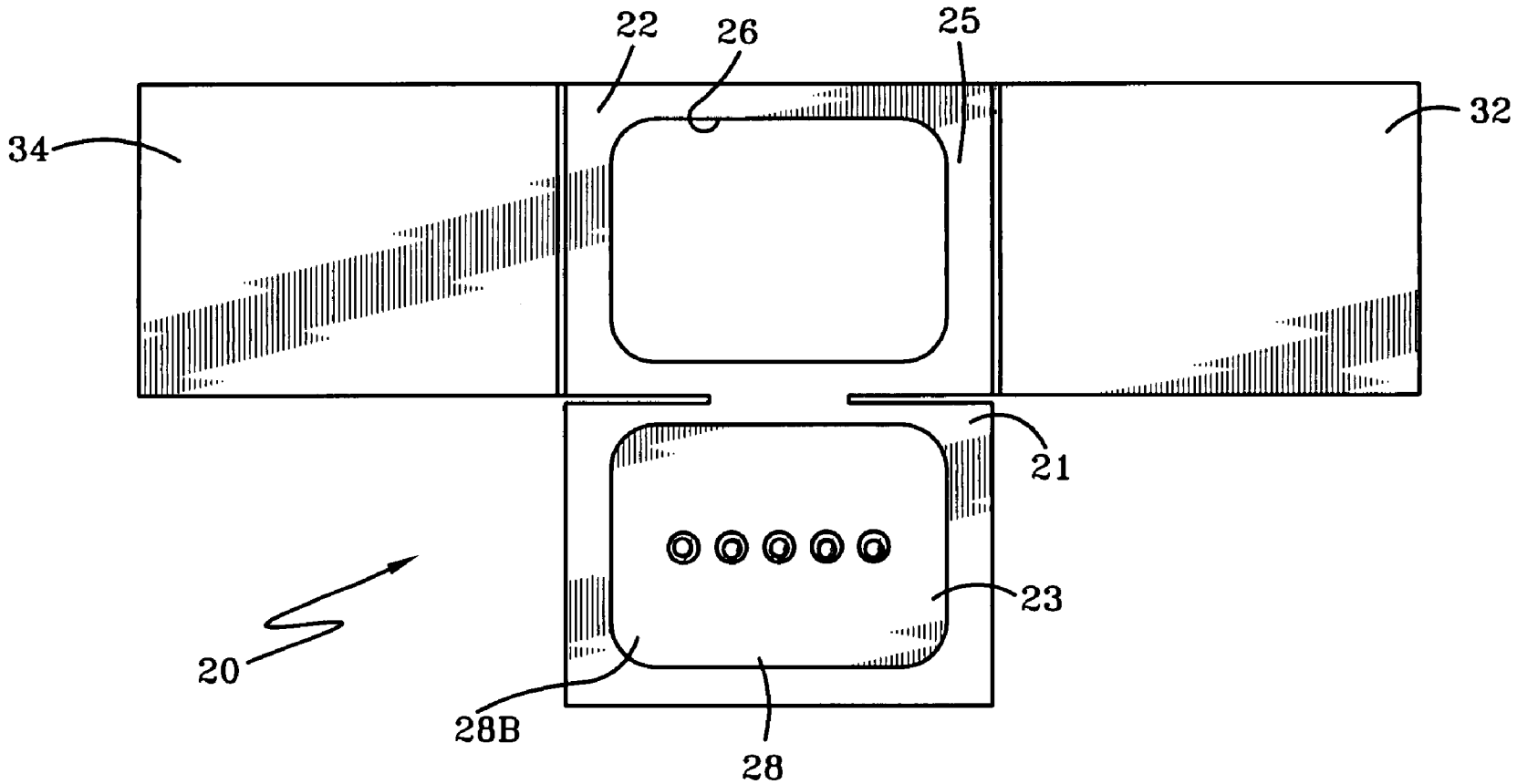
FIG. 13 is a view similar to that shown in FIG. 10, but with the middle member shown as a piece separate from the rest of the housing.

With reference now to FIGS. 7-13, the housing 20 also preferably includes a middle member 28 that provides additional stability to the product dispenser 10. The middle member 28 has a plurality of holes 30 which are used to receive the compartments 74 in the blister card 70. Two embodiments for the middle member 28 are preferred. In the first embodiment, shown in FIGS. 7-11, the middle member is referenced 28A and is connected to the bottom member 21. Most preferably for this embodiment the middle member 28A can pivot or fold at its connections to the bottom member 21 so that middle member 28A can lay on top of the blister card 70 which is placed onto the bottom member 21. The result of this folding motion can be visualized by comparing FIG. 9 to FIG. 10. In the second embodiment, the middle member is referenced 28B and is a separate piece as shown in FIG. 12. Again, the middle member 28B is placed on top of the blister card 70 as shown in FIG. 13. This placement of the middle member 28B is preferably done precisely with the use of known manufacturing equipment.

With reference now to FIGS. 1-6 and 11, the blister cover 100 will be described in more detail. The blister cover 100 can be formed of any material chosen with sound engineering judgment. However, in the preferred embodiment the blister cover 100 is formed of a see-through (transparent) PVC material. The transparent blister cover 100 makes it easy to visually determine which compartments 74 have products 76 and which do not. The blister cover 100 preferably has a mid-portion 104 and a flange portion 106 that extends from at least a segment of the mid-portion 104. In the preferred embodiment, the flange portion 106 completely surrounds the mid-portion 104, as shown. The flange portion 106 is used to attach the blister cover 100 to the housing 20, or is used to help the blister cover 100 be retained by the housing 20, or is used to help the blister cover 100 be retained by the housing 20, and relative to the blister card 70 as will be described further below. The mid-portion 104 includes a plurality of dispensing areas 102. Each dispensing area 102 is positioned adjacent to a compartment 74 on the blister card 70. Thus, it should be noted that in the preferred embodiment there are two layers of material between the user's finger or other device used to remove the product 76 and the product itself, namely, the first member 72 of the blister card and the blister cover 100.

With continuing reference to FIGS. 1-6 and 11, preferably the mid-portion 104 includes a plurality of recesses 116 surrounding each dispensing area 102. It is also preferred that the mid-portion 104 of the blister cover 100 have a top surface 114 adjacent to the dispensing areas 102. Most preferably the top surface 114 is formed on both sides of the dispensing areas 102, as shown. This top surface 114 works with the recesses 116 to prevent children from being able to bite individual compartments 74 in the blister card 70. The compartments 74 cannot be accessed by a child's teeth because the compartments 74 do not extend above the top surface 114 sufficiently for the compartments 74 or even the dispensing areas 102 to be accessible for biting. Preferably, the mid-portion 104 also includes at least a first communication surface 118 that could be part of top surface 114. Most preferably there are two such surfaces as shown. These communication surfaces 118 can be used for communicating to the user of the product dispenser 10. While the particular message communicated can be any, some examples include identifying the dosage text, providing day labels, providing information in Braille (as shown) or providing other beneficial information.

Still referring to FIGS. 1-6 and 11, it is preferred that each dispensing area 102 have a shape that matches the top of each compartment 74 in the blister card 70. This is illustrated best in FIG. 6 where it can be seen that a top 82 of each compartment 74 is curved. A bottom surface 110 of each dispensing area 102 has a similar curved shape. Of course, other matching shapes would work equally well with this invention. However, such a curved shape is typical for blister card compartments and thus is preferred with this invention. The mid-portion 104 of the blister card 70 also defines a cavity 108 that receives the blister card 70. The blister card 70 has a height H1 from the top 82 of each compartment to a bottom 84 of the second member 78. A height H2 exists between a bottom surface 110 of each dispensing area 102 and the bottom 112 of the cavity 108. In the preferred embodiment, height H1 is substantially equal to height H2. This minimizes the distance between the bottom surface 110 of each dispensing area 102 and the top of each compartment 74. This in turn minimizes the motion required by the user when it is desired to dispense a product 76 from a compartment 74.

Figure 8:
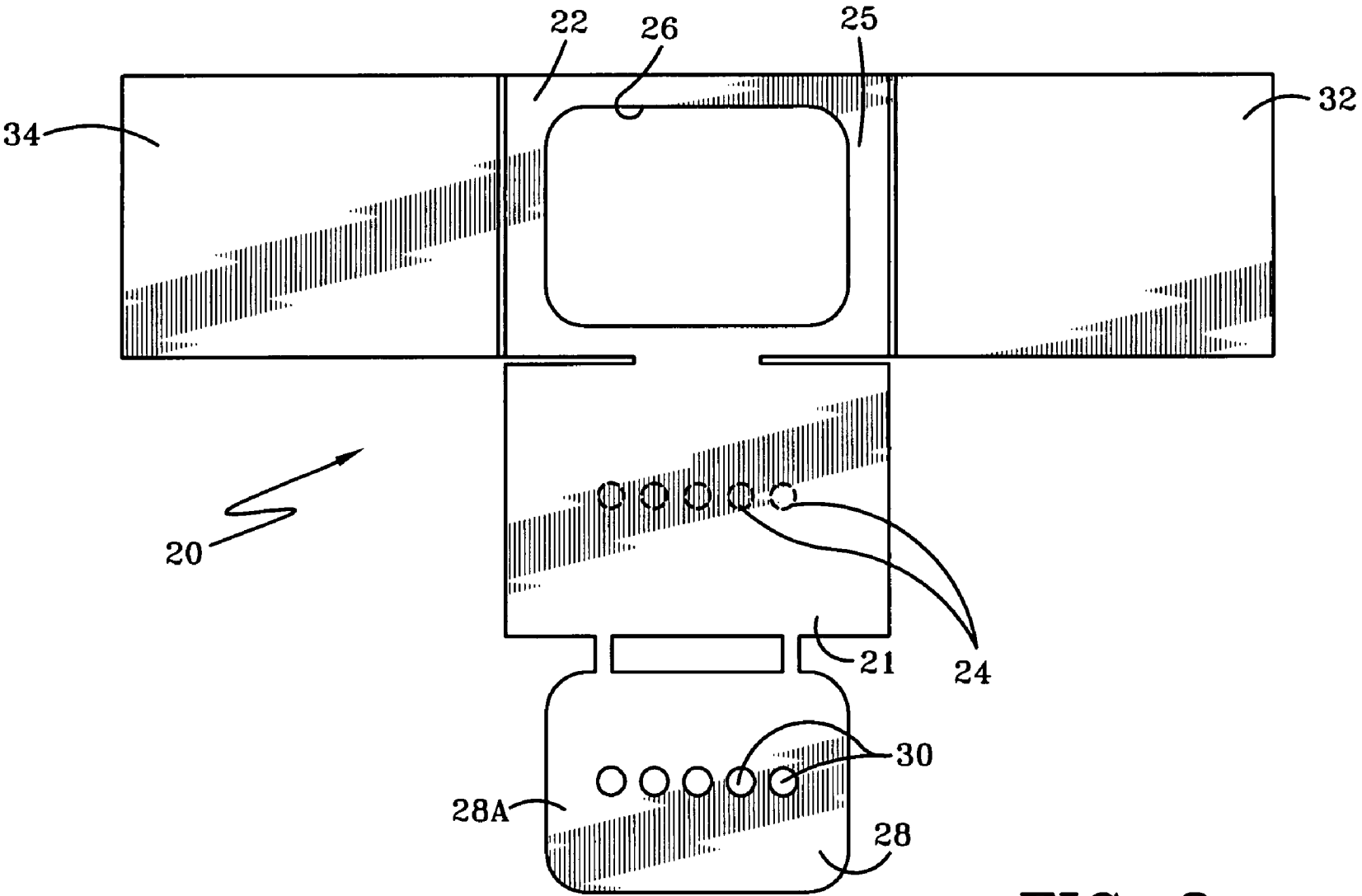
FIG. 8 is a top view of the housing similar to FIG. 7, but showing how the side members are folded into place.
Figure 9:
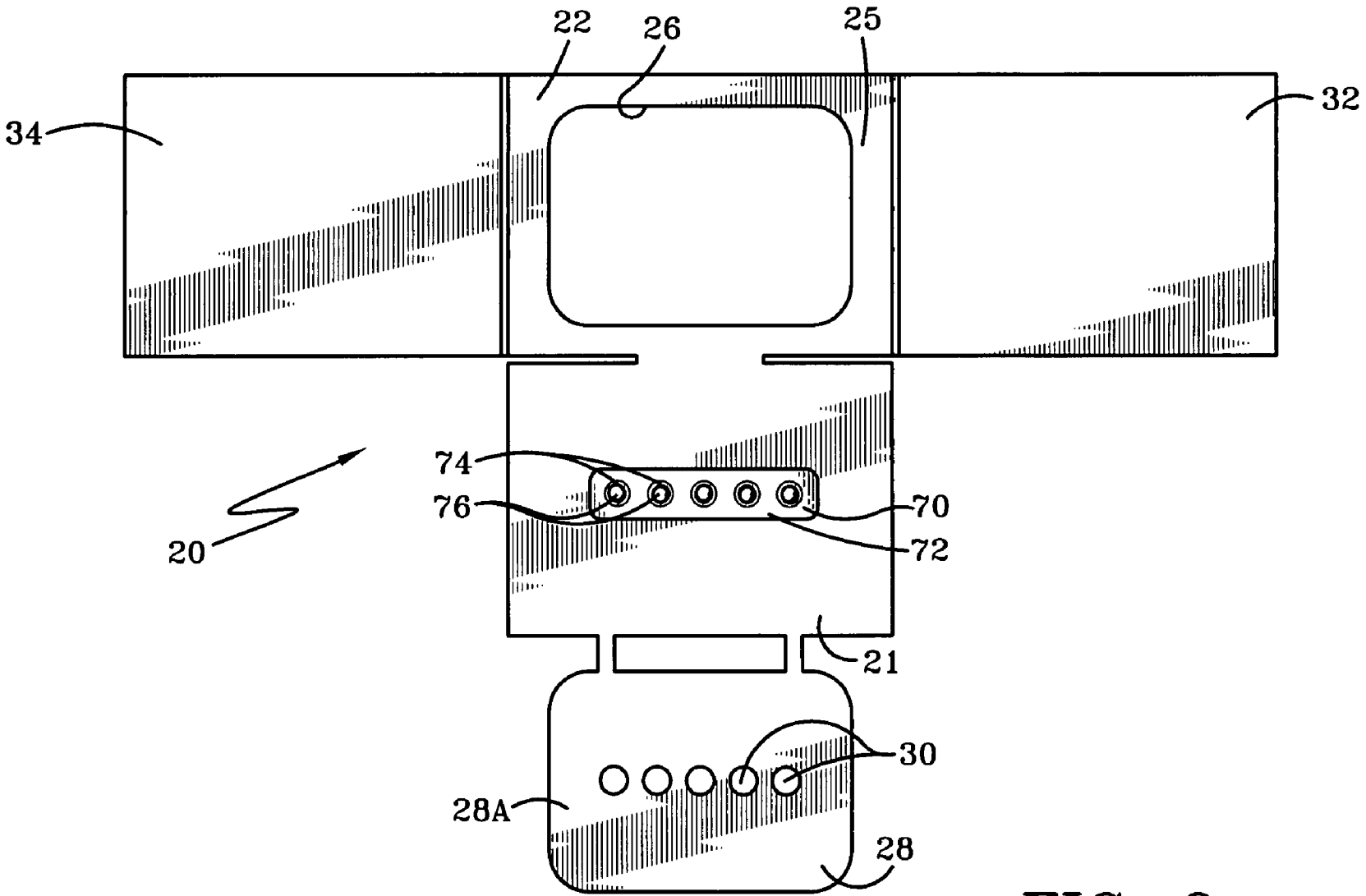
FIG. 9 is a view similar to that shown in FIG. 8, but with the blister card positioned onto the bottom member of the housing.

With reference now to FIGS. 1 and 8-13, a method for assembling the product dispenser 10 will now be described. First, the housing 20 is positioned as shown in FIG. 8 (or FIG. 12). Next, the blister card 70 is positioned onto the bottom member 21 of the housing 20. Next, the middle member 28 is positioned over the blister card 70 such that each of the holes 30 in the middle member 28 receives a compartment 74 from the blister card 70 as shown in FIG. 10 (or FIG. 13). The first embodiment middle member 28A thus serves to align the blister card 70 with the bottom member 21. More particularly, the middle member 28A aligns the frangible areas 80 on the second member 78 with the frangible areas 24 on the bottom member 21. Next, as shown in FIG. 11, the blister cover 100 is positioned over top of both the middle member 28 of the housing 20 as well as the blister card 70. Thus, it should be noted that in the preferred embodiment, the cavity 108 in the blister cover 100 receives both the middle member 28 of the housing 20 as well as the blister card 70.

With continuing reference to FIGS. 1 and 8-13, the blister cover 100 is then attached to the housing 20. While any method of attachment chosen with sound engineering judgment will work with this invention, two alternate embodiments are preferred. The first embodiment for attachment uses a two-step heat sealing process. In particular, it is preferred that a bottom surface 107 of the flange portion 106 of the blister cover 100 is heat sealed to a top surface 23 of the bottom member 21 of the housing 20. The mid-portion 104 of the blister cover 100 is then extended through the aperture 26 in the top member 22 of the housing 20 such as is shown in FIG. 1. Then a top surface 109 of the flange portion 106 of the blister cover 100 is heat sealed to a bottom surface 25 of the top member 28 of the housing 20. The second embodiment for attachment is similar but uses a two-step adhering process. It should be noted that any adhesive chosen with sound engineering judgment can be used for this adhering process. In particular, it is preferred that the bottom surface 107 of the flange portion 106 of the blister cover 100 is adhered to the top surface 23 of the bottom member 21 of the housing 20. The mid-portion 104 of the blister cover 100 is then extended through the aperture 26 in the top member 22 of the housing 20 such as is shown in FIG. 1. Then the top surface 109 of the flange portion 106 of the blister cover 100 is adhered to the bottom surface 25 of the top member 28 of the housing 20. For either attachment embodiment, the blister cover 100 is attached to the housing 20 in position relative to the blister card 70 so that each dispensing area 102 is in alignment with a corresponding compartment 74.

Still referring to FIGS. 1 and 8-13, the first side member 32 is next folded over the blister cover 100 and then the second side member 34 is folded over the first side member 32. Finally, the second side member 34 may be secured to the bottom member 21 in any manner chosen with sound engineering judgment such as, for example, a decal or tape having one side with an adhesive applied.

With reference now to FIGS. 1-6 and 11, it is generally very easy to dispense a product 76 from the product dispenser 10 of this invention. First the securing means such as tape is removed and the first and second side members 32, 34 are folded out of the way. At this point, the product dispenser 10 is in the condition shown in FIG. 1. Next, the user would press one of the dispensing areas 102 against the corresponding compartment 74. This in turn forces the first product through the corresponding frangible 80 area of the second member 78 and then through the corresponding frangible area 24 of the bottom member 21. This then releases the product 76 from the compartment 74 where it may be used by the adult as required.

With reference now to FIGS. 14-17, another embodiment of a product dispenser 300 is shown. Much of the structure of the product dispenser 300 is similar to that of the product dispenser 10 described above. However, there are important differences that will now be discussed. First, it should be noted that product dispenser 300 is intended for use with a conventional blister card 302 having peelable areas 304, not frangible areas, that are juxtaposed to the compartments 308 that are intended to hold products 312. Next, while the blister cover 316 has a plurality of dispensing areas 320, one for each compartment 308, note that each dispensing area 320 is offset from a corresponding compartment 308. By offset it is meant that the dispensing areas 320 are not aligned directly above each compartment 308, as with the product dispenser 10 described above, but rather each dispensing area 320 is positioned to the side of each compartment 308. While in the preferred embodiment each dispensing area 320 is positioned to the outside of each compartment 308, as shown, it should be understood that the dispensing areas could be placed on the inside of each compartment or between compartments and still work well.

With continuing reference to FIGS. 14-17, a housing 324 is constructed similar to the housing 20 described above. However, each frangible area 328 is positioned adjacent to the edge of each peelable area 304. In an alternative embodiment, the frangible areas could instead be holes but this makes it less child resistant. As a result, opening a frangible area 328 exposes the peelable area 304 to the user. The reason each dispensing area 320 is positioned to the side of each compartment 308 is so that when the user exerts a force onto the dispensing area 320 the force is communicated directly to the peelable area 304 of the blister card 302 and then the frangible area 328 of the housing 324—not to the compartment 308. Preferably, each dispensing area 320 has an application surface 332 that is inset from a top surface 336. The application surface 332 is the surface pressed by the user in order to remove a product 312 from a compartment 308. Most preferably, the application surface 332 is positioned in direct communication with a middle member 338 of the housing 324. As a result, the user only has to move the application surface 332 a minimal distance to open a peelable area 304.

Figure 14:
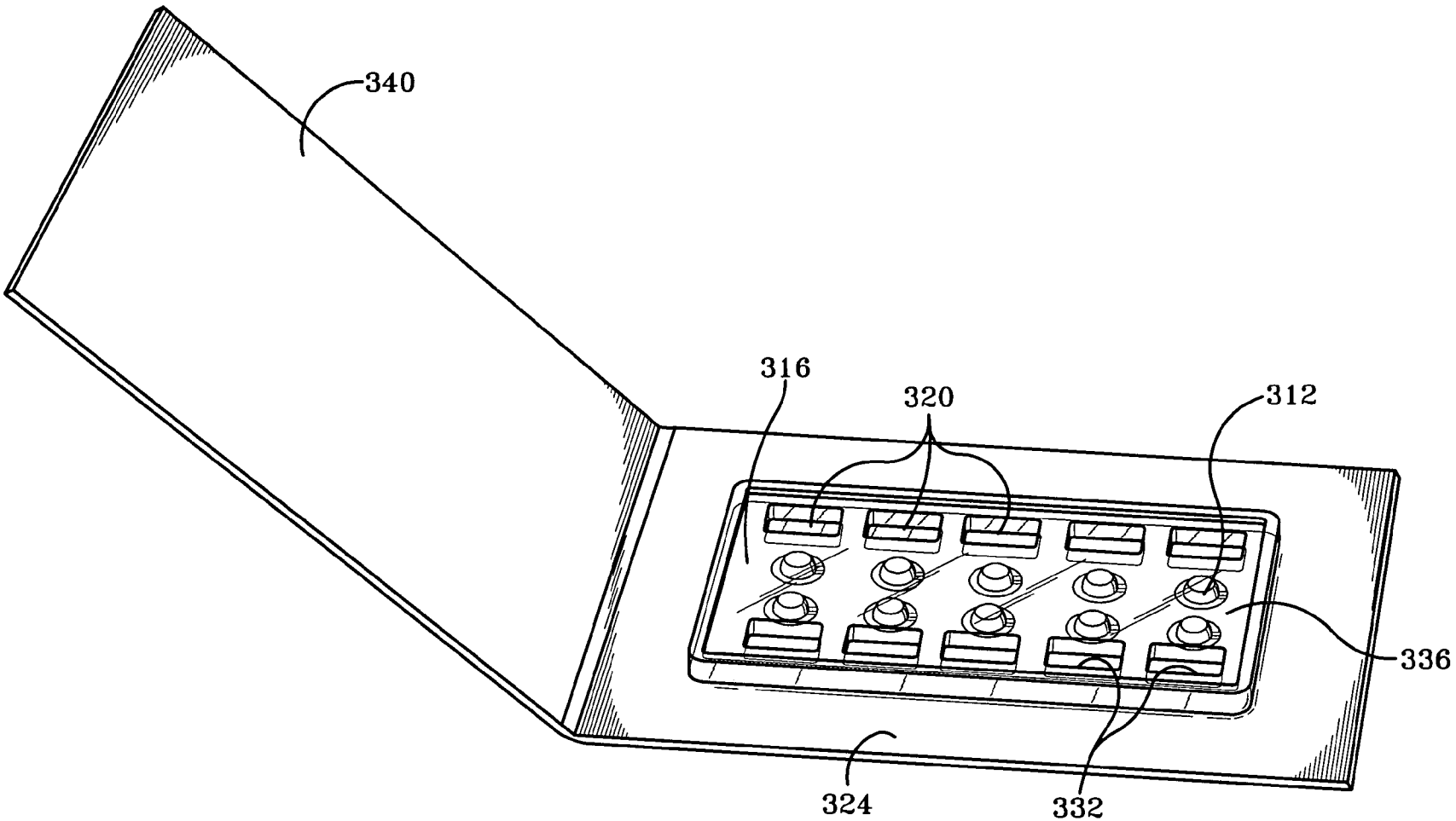
FIG. 14 is a perspective view of another product dispenser embodiment of this invention shown with the side member folded open so that access to the products can be achieved.
Figure 15:
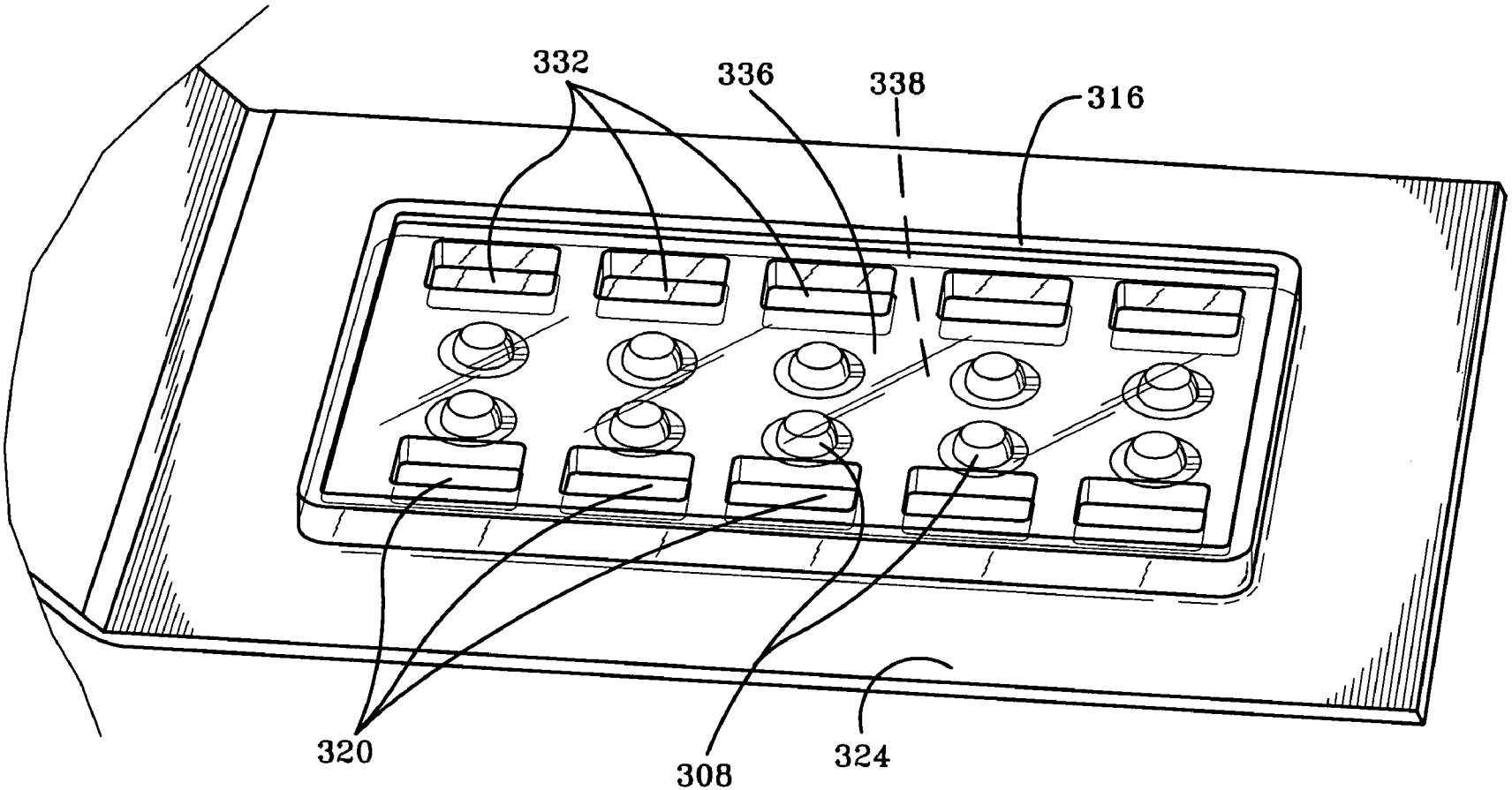
FIG. 15 is a perspective view of the blister cover of FIG. 14 showing a top surface adjacent to the dispensing areas for use in preventing children from biting individual compartments in the blister card.
Figure 16:
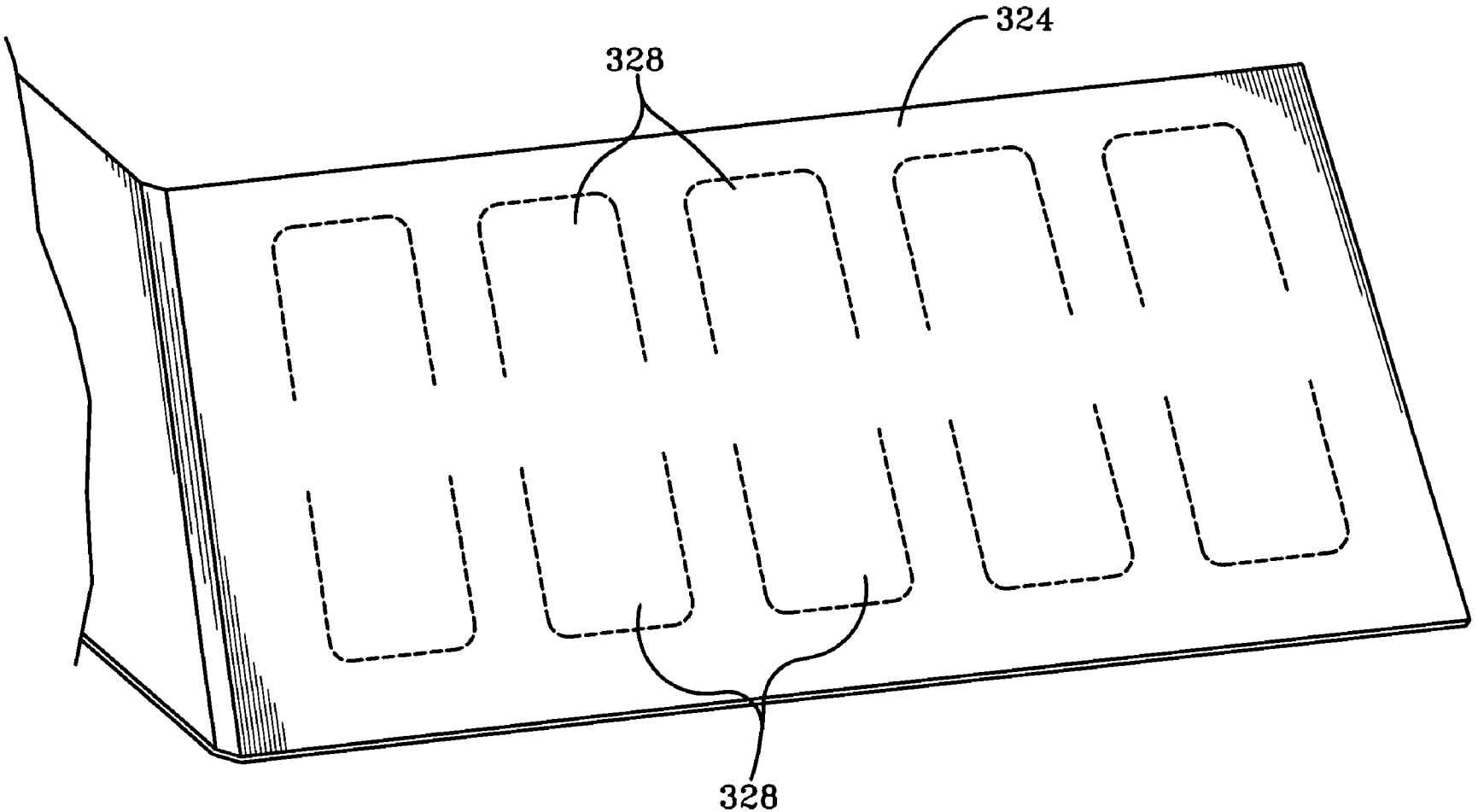
FIG. 16 is a bottom view of the housing showing the frangible areas.
Figure 17:
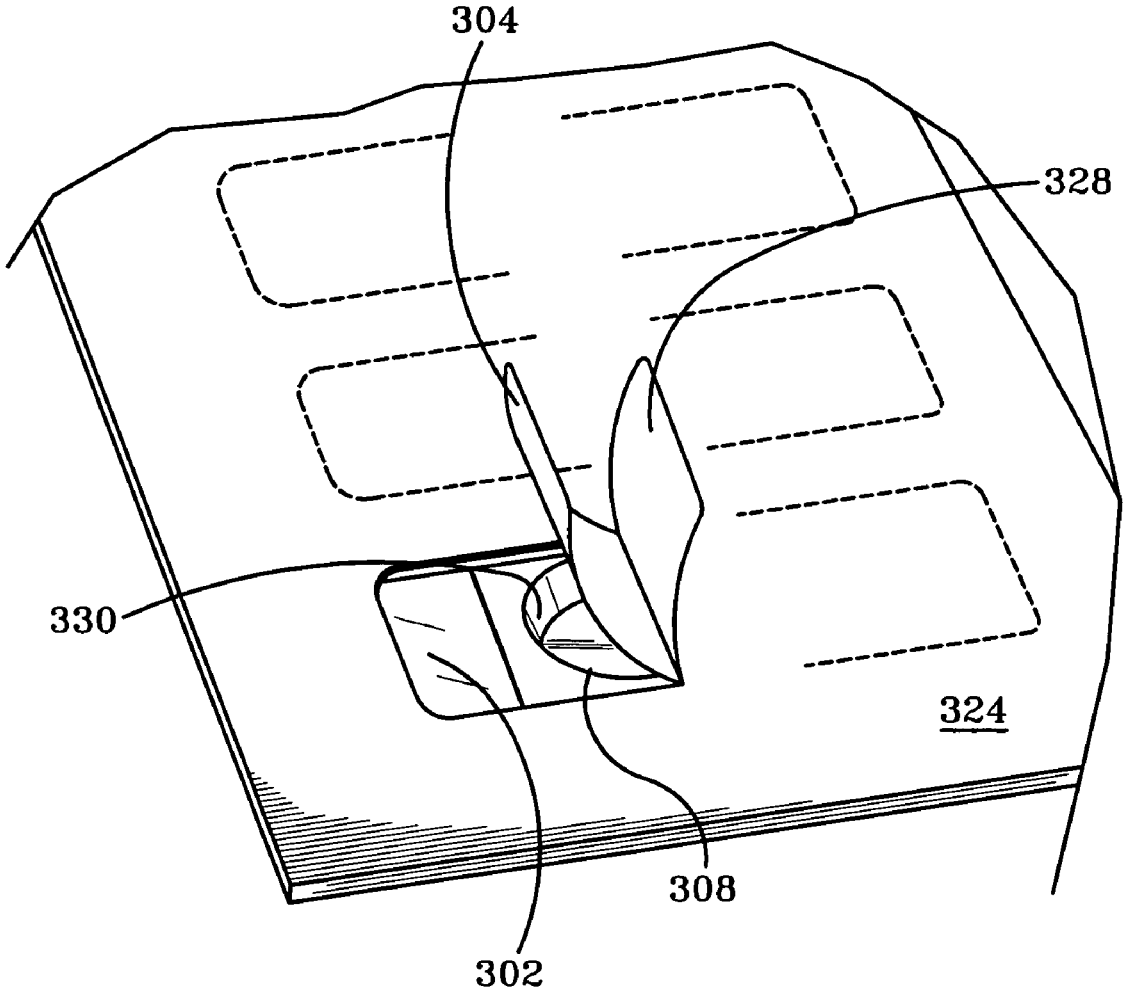
FIG. 17 is a close up perspective view showing how the compartment is accesses in order to remove a product.

With reference now to FIGS. 1 and 14, the product dispenser 300 is assembled substantially like the product dispenser 10 described above. One difference, shown, is that the housing 324 includes only a single side member 340 that is folded over the blister cover 316. Of course both product dispensers 10, 300 can have any number of side members chosen with sound engineering judgment.

With reference now to FIGS. 14-17, it is generally very easy to dispense a product 312 from the product dispenser 300. First the securing means is removed and the side member 340 is folded out of the way. At this point, the product dispenser 300 is in the condition shown in FIG. 12. Next, the user would press the application surface 332 one of the dispensing areas 320 against the corresponding peelable area 304 of the blister card 302 and frangible area 328 of the housing 324. This pressing force removes an edge of the peelable area 304 and an edge of the frangible area 328 away from the corresponding compartment 308. It should be noted that this pressing force does not impact the compartment 308 and thus is not communicated to the product 312. Both the peelable area 304 and frangible area 328 are then peeled back to create an opening 330 to the compartment 308. The product 312 can then easily be removed from the compartment 308 by allowing it to drop or fall out through the opening 330 under the force of gravity. Thus while the product dispenser 300 can be used with any product 312, it is especially useful with products that are formed of fragile materials, such as certain medications, wafers, etc. that would be damaged if dispensed through the direct force used with the product dispenser 10 described above.

Figure 18:
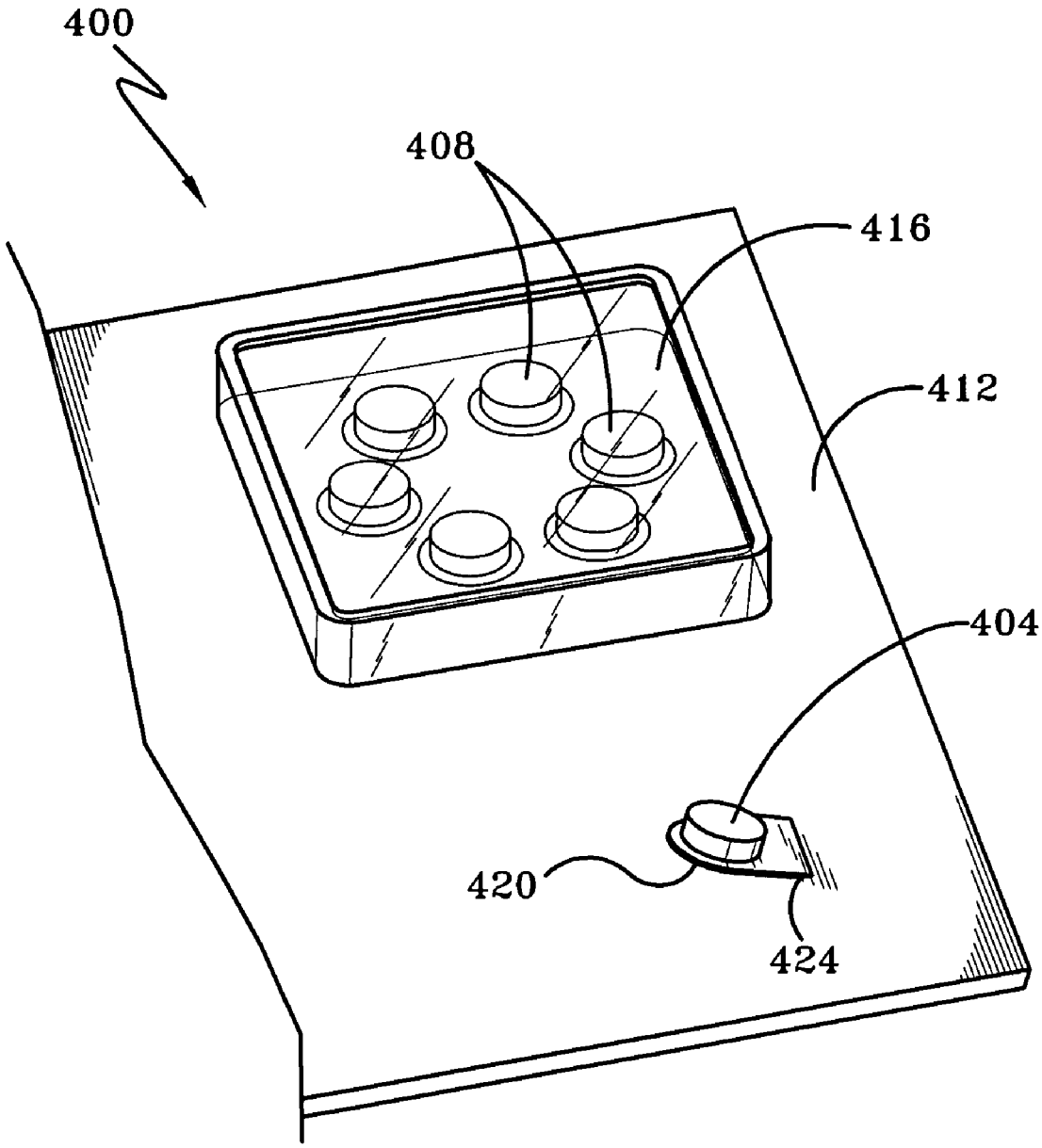
FIG. 18 is a perspective view of another product dispenser embodiment of this invention showing an optional product chamber.

With reference now to FIG. 18, another product dispenser 400 is shown. This embodiment shows an optional product chamber 404. The product chamber 404 is intended for use in storing any portion of product that has previously been removed from a compartment 408. In the embodiment shown, the product chamber 404 is attached to the housing 412. Optionally, the product chamber 404 could attach to or be made with the blister cover 416. The product chamber 404 may include a cavity 420 and a connection member 424 that is preferably pivotally connected to the housing 412. To access the cavity 420 it is only necessary to pivot the product chamber 404 about the connection member 424.

The preferred embodiments have been described, hereinabove. It will be apparent to those skilled in the art that the above methods may incorporate changes and modifications without departing from the general scope of this invention. It is intended to include all such modifications and alterations in so far as they come within the scope of the appended claims or the equivalents thereof.

I claim:

1. A product dispenser comprising:

a housing;

a blister card comprising a first member defining a plurality of compartments for use in holding a corresponding plurality of products and a second member used to seal the plurality of products within the plurality of compartments, the second member having a plurality of frangible areas, one frangible area juxtaposed to each compartment, for use in individually removing the plurality of products from the plurality of compartments;

a blister cover for use in covering the plurality of compartments, the blister cover having a plurality of dispensing areas for use in individually transferring pressure to the compartments and forcing the corresponding products through the frangible areas; and connecting means for operatively connecting the blister card and the blister cover to the housing so that each dispensing area in the blister cover is in alignment with a corresponding compartment in the blister card;

wherein the blister cover comprises a mid-portion having the plurality of dispensing areas and a flange portion extending from at least a segment of the mid-portion, the flange portion for use in attaching the blister cover in position relative to the blister card; and wherein the housing comprises a top member having an aperture that receives the mid-portion of the blister cover, a middle member having a plurality of holes, each of the plurality of holes in the middle member receiving a compartment from the blister card, and a bottom member having a plurality of frangible areas, each frangible area on the bottom member being juxtaposed to a corresponding frangible area on the second member of the blister card.

2. The product dispenser of claim 1 further comprising:

a product chamber for use in storing any portion of product that has previously been removed from a compartment.

3. The product dispenser of claim 2 wherein the product chamber is attached to the housing.

4. The product dispenser of claim 2 wherein the product chamber is attached to the blister cover.

5. The product dispenser of claim 1 wherein:

the blister card has a height H1 from the top of each compartment to the bottom of the second member; and the mid-portion of the blister cover defines a cavity that receives the blister card, a height H2 between a bottom surface of each dispensing area and the bottom of the cavity being substantially equal to the height H1.

6. The product dispenser of claim 1 wherein the mid-portion of the blister cover has a top surface adjacent to the plurality of dispensing areas for use in preventing children from biting individual compartments in the blister card.

7. The product dispenser of claim 1 wherein the mid-portion comprises a plurality of recesses, each dispensing area being positioned within a recess.

8. The product dispenser of claim 1 wherein the mid-portion comprises at least a first communication surface.

9. The product dispenser of claim 1 wherein each dispensing area has a shape that matches the shape of the top of each compartment in the blister card.

10. The product dispenser of claim 1 wherein the mid-portion of the blister cover defines a cavity that receives the blister card and the middle member.

11. The product dispenser of claim 1 wherein the middle member is pivotally connected to the bottom member of the housing.

12. The product dispenser of claim 1 wherein the middle member is attached to the bottom member of the housing.

13. A method of dispensing a product comprising the steps of:

providing a blister card having a first member defining at least a first compartment for use in holding a first product and a second member used to seal the first product within the first compartment, the second member having at least a first frangible area juxtaposed to the first compartment for use in removing the first product from the first compartment;

providing a blister cover for use in covering the first compartment, the blister cover having a mid-portion with at least a first dispensing area positioned so that the first dispensing area is in alignment with the first compartment, and further having a flange portion extending from at least a segment of the mid-portion for use in attaching the blister cover in position relative to the blister card;

providing a housing operatively connected to the blister card and the blister cover, the housing having a top member with an aperture for receiving the mid-portion of the blister cover, a middle member with at least a first hole for receiving the first compartment, and a bottom member having at least a first frangible area juxtaposed to the first frangible area of the second member of the blister card;

pressing the first dispensing area against the first compartment; and forcing the first product through the first frangible area of the second member and the first frangible area of the housing.

* * * * *